US007900793B2

(12) United States Patent
Hanson et al.

(10) Patent No.: US 7,900,793 B2
(45) Date of Patent: Mar. 8, 2011

(54) MULTI-PIECE COMPARTMENTED CONTAINER WITH VENTING

(75) Inventors: Scott A. Hanson, Grayslake, IL (US); Frank A. Petlak, Antioch, IL (US); Dmitriy Faktorovich, Naperville, IL (US)

(73) Assignee: Pactiv Corporation, Lake Forest, IL (US)

( * ) Notice: Subject to any disclaimer, the term of this patent is extended or adjusted under 35 U.S.C. 154(b) by 348 days.

(21) Appl. No.: 12/070,396

(22) Filed: Feb. 19, 2008

(65) Prior Publication Data

US 2009/0206090 A1 Aug. 20, 2009

(51) Int. Cl.

| | |
|---|---|
| ***B65D 51/16*** | (2006.01) |
| ***B65D 6/28*** | (2006.01) |
| ***B65D 8/18*** | (2006.01) |
| ***B65D 1/24*** | (2006.01) |
| ***B65D 1/36*** | (2006.01) |
| ***B65D 85/00*** | (2006.01) |

(52) U.S. Cl. ..... 220/526; 220/4.21; 220/366.1; 220/367.1; 220/528; 220/785

(58) Field of Classification Search ..... 220/4.21, 220/366.1, 367.1, 526, 528, 529, 554, 556, 220/575, 785

See application file for complete search history.

(56) References Cited

U.S. PATENT DOCUMENTS

| | | | | |
|---|---|---|---|---|
| 1,607,863 | A | 11/1926 | Betts | |
| 1,607,864 | A | 11/1926 | Butler | |
| 2,717,505 | A | 9/1955 | Andersson | |
| 2,944,694 | A | 7/1960 | Kinsey | |
| 3,589,554 | A | 6/1971 | Smith | |
| 3,851,789 | A | 12/1974 | Case et al. | 220/307 |
| D262,839 | S | 2/1982 | Daenen et al. | |
| 4,925,047 | A | 5/1990 | Valentine et al. | |
| 5,123,564 | A | 6/1992 | Hobson | |
| 5,624,051 | A * | 4/1997 | Ahern et al. | 220/553 |
| 5,730,313 | A | 3/1998 | Hayes et al. | 220/526 |
| 5,947,321 | A | 9/1999 | Vadney | 220/367.1 |
| 5,950,834 | A * | 9/1999 | Woodnorth et al. | 206/541 |
| 6,074,676 | A | 6/2000 | Cadiente et al. | 426/106 |
| 6,349,847 | B1 | 2/2002 | Mangla et al. | 220/754 |
| 6,845,878 | B2 | 1/2005 | Hayes et al. | 220/839 |
| 7,124,910 | B2 * | 10/2006 | Nordland | 220/839 |
| D547,124 | S | 7/2007 | Peretz | |
| 7,243,813 | B2 | 7/2007 | Krueger | |
| 7,552,840 | B2 * | 6/2009 | Gitschlag et al. | 220/575 |
| 2004/0094548 | A1 | 5/2004 | Laveault | |
| 2004/0188442 | A1 * | 9/2004 | Ohyama | 220/367.1 |
| 2005/0051549 | A1 | 3/2005 | Nelson | |
| 2005/0205570 | A1 * | 9/2005 | Ramirez et al. | 220/4.21 |
| 2005/0208188 | A1 | 9/2005 | Garwood | |
| 2007/0065545 | A1 | 3/2007 | Vovan | |

* cited by examiner

*Primary Examiner* — Anthony Stashick
*Assistant Examiner* — Madison L Wright
(74) *Attorney, Agent, or Firm* — Nixon Peabody LLP

(57) ABSTRACT

A compartmentalized container includes a base, an insert and a lid. The base includes a bottom and a sidewall. The sidewall encompasses and extends generally upwardly from the bottom. The insert is coupled with the base in which the coupled insert and base form a venting area. The lid is coupled with at least one of the insert and the base. The lid forms at least one vent that is in communication with the venting area formed with the insert and the base.

25 Claims, 18 Drawing Sheets

MULTI-PIECE COMPARTMENTED CONTAINER WITH VENTING

FIELD OF INVENTION

The present invention relates generally to a multi-piece compartmented container. More particularly, the present invention relates to a multi-piece compartmented container to be typically used with food products having different venting needs.

BACKGROUND OF THE INVENTION

The use of inexpensive polymeric, paper or metal packaging containers has become popular, especially for preparing, serving and storing various food products. Polymeric, paper and metal containers generally have been used for preparing, serving and storing the food product(s) disposed therein. In some applications, a plurality of food products is desirably prepared, served and/or stored in one container. It is desirable to keep the different food products separated from each other. One method of keeping the different foods separated from each other is by use of multiple compartments. It is desirable to have compartments that have different venting accommodations. It is also desirable to minimize the footprint of the package, while maximizing the overall capacity and compartment size.

SUMMARY OF THE INVENTION

According to one embodiment, a compartmentalized container includes a base, an insert and a lid. The base includes a bottom and a sidewall. The sidewall encompasses and extends generally upwardly from the bottom. The insert is coupled with the base. The coupled insert and base form a venting area. The lid is coupled with at least one of the insert and the base. The lid forms at least one vent that is in communication with the venting area formed with the insert and the base.

According to another embodiment, a compartmentalized container includes a base, an insert and a lid. The base includes a bottom, a sidewall and a divider. The sidewall encompasses and extends generally upwardly from the bottom. The divider splits the bottom of the base into at least a first base section and a second base section. The divider includes a top surface. The insert is coupled with the base. The assembled insert and base form a venting area. The insert rests on at least a portion of the top surface of the divider. The lid is coupled with at least one of the insert and the base. The lid forms at least one vent that is in communication with the venting area formed with the insert and the base.

According to one method, a compartmentalized container is formed by providing a base including a bottom and a sidewall. The sidewall encompasses and extends generally upwardly from the bottom. The insert is coupled with the base. The assembled insert and base form a venting area. The lid is interlocked with at least one of the insert and the base to form the compartmentalized container. The lid forms at least one vent that is in communication with the venting area formed between the insert and the base.

According to another method, a compartmentalized container is formed by providing a base including a bottom, a sidewall and a divider. The sidewall encompasses and extends generally upwardly from the bottom. The divider splits the bottom of the base into at least a first base section and a second base section. The divider includes a top surface. An insert is coupled with the base. The assembled insert and base form a venting area. The insert rests on at least a portion of the top surface of the divider. The lid is interlocked with at least one of the insert and the base so as to form the compartmentalized container. The lid forms at least one vent that is in communication with the venting area formed between the insert and the base.

Figure 1A:
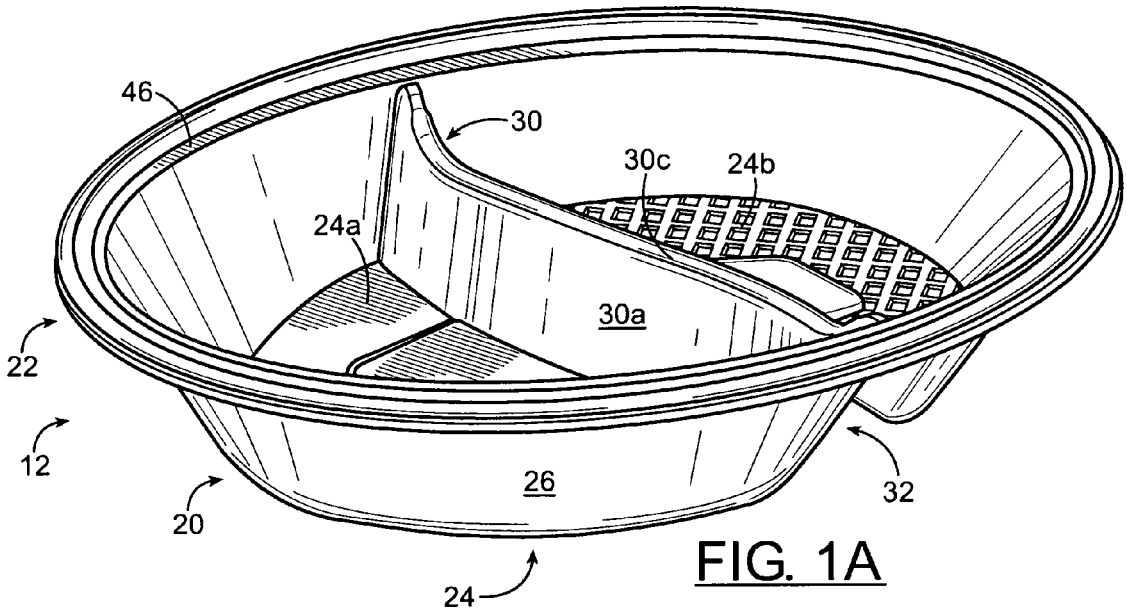
FIG. 1*a* is a perspective view of a base according to one embodiment to be used in forming a compartmentalized container.

While the invention is susceptible to various modifications and alternative forms, specific embodiments thereof have been shown by way of example in the drawings and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DESCRIPTION OF ILLUSTRATIVE EMBODIMENTS

Figure 5A:
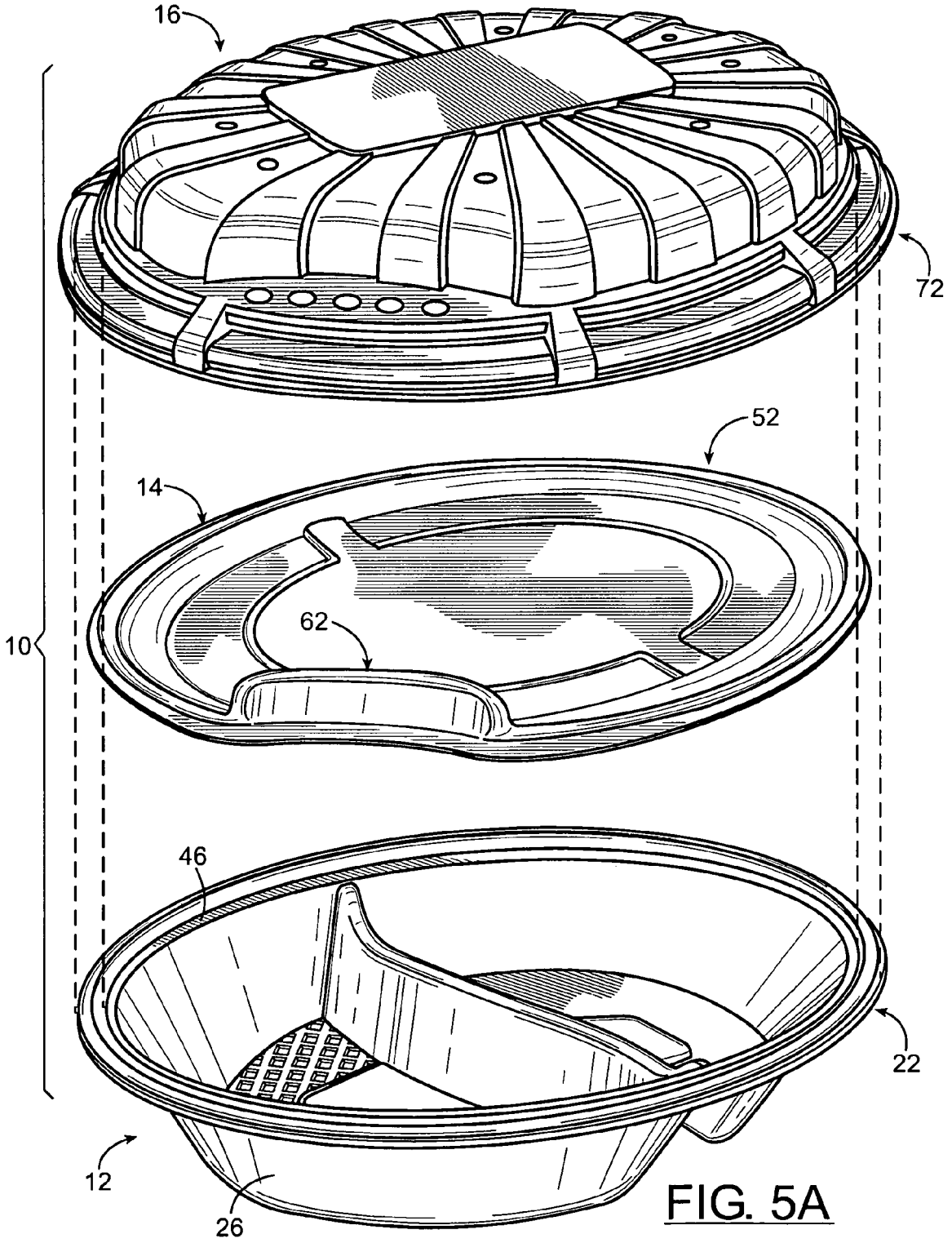
FIG. 5*a* is an exploded view of the base of FIGS. 1*a*-1*c*, the insert of FIGS. 2*a*-2*c* and the lid of FIGS. 4*a*, 4*b*.
Figure 5B:
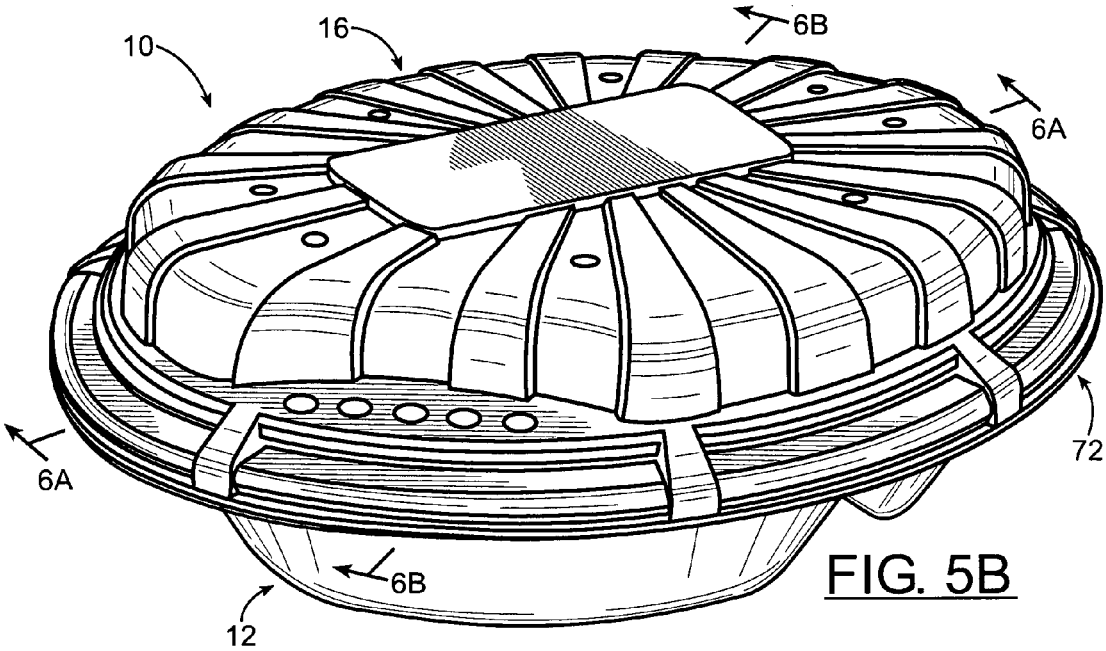
FIG. 5*b* is a perspective view of the base of FIGS. 1*a*-1*c*, the insert of FIGS. 2*a*-2*c* and the lid of FIGS. 4*a*, 4*b* in an assembled position.
Figure 5C:
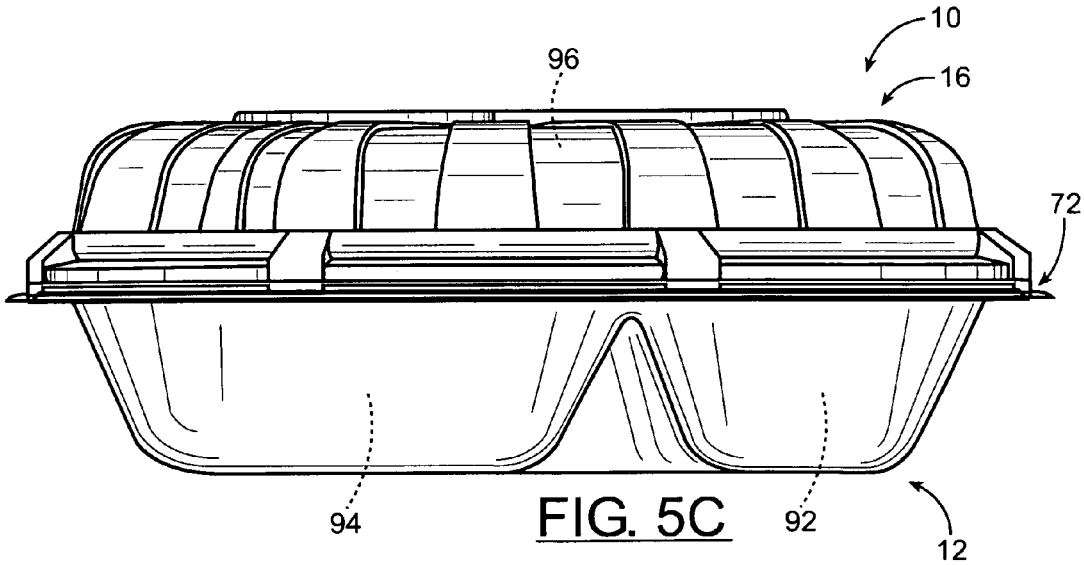
FIG. 5*c* is a side view of the base of FIGS. 1*a*-1*c*, the insert of FIGS. 2*a*-2*c* and the lid of FIGS. 4*a*, 4*b* in an assembled position.

Referring to FIGS. 5*a*-5*c*, a compartmentalized container 10 including a base 12, insert 14 and a lid 16 is shown. The compartmentalized container 10 is shown as being generally circular or oval in nature. The height and shape of the compartmentalized container may vary from that shown without departing from the scope of the invention. It is contemplated that the compartmentalized container may be other shapes such as rectangular, square, hexagonal, octagonal or other polygonal and non-polygonal shapes.

The compartmentalized containers are typically used with food items. Such food containers may be used for serving, storing, preparing and/or re-heating the food. It is contemplated that the compartmentalized containers may be used in applications other than with food.

Figure 1B:
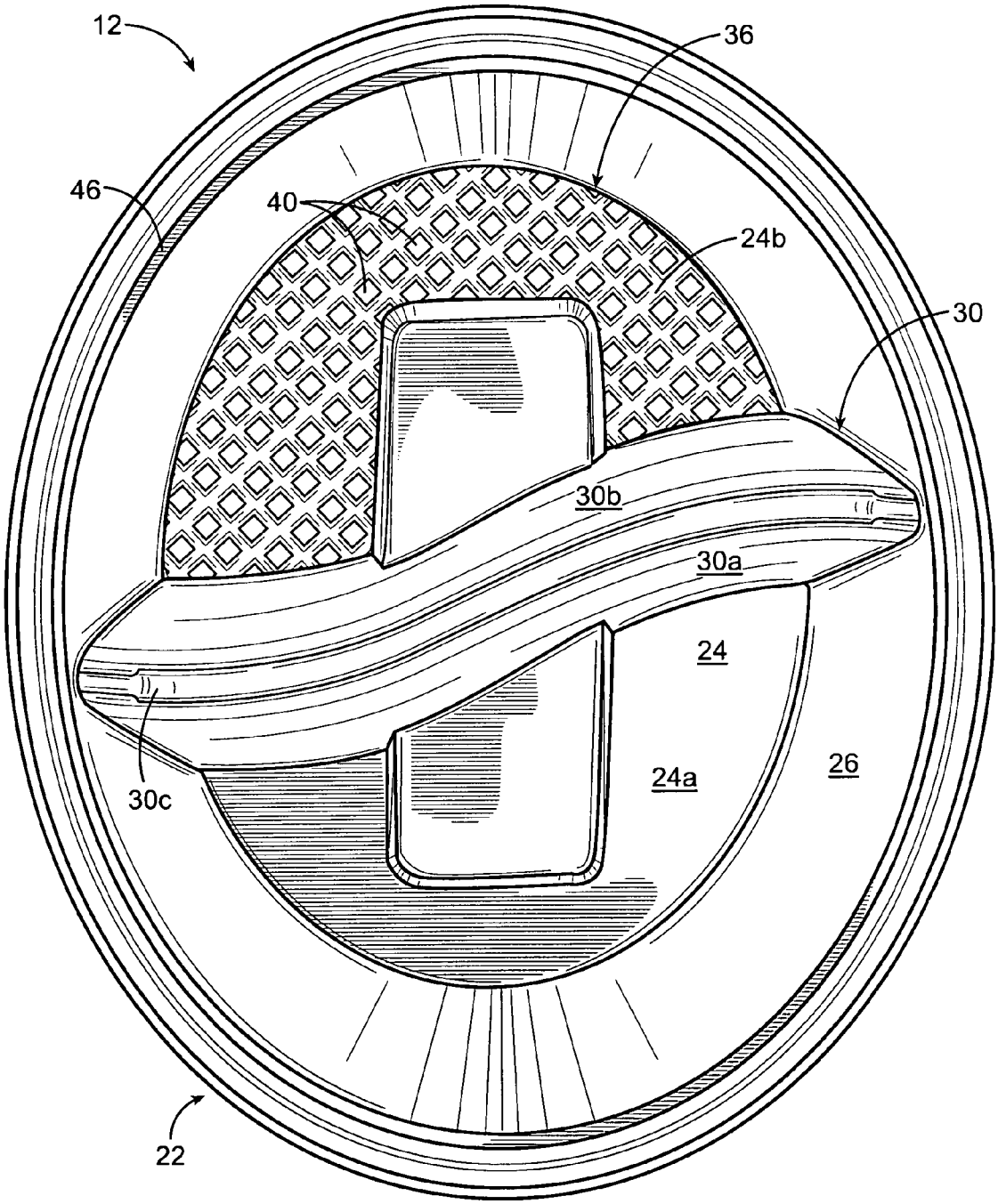
FIG. 1*b* is a top view of the base of FIG. 1*a*.
Figure 1C:
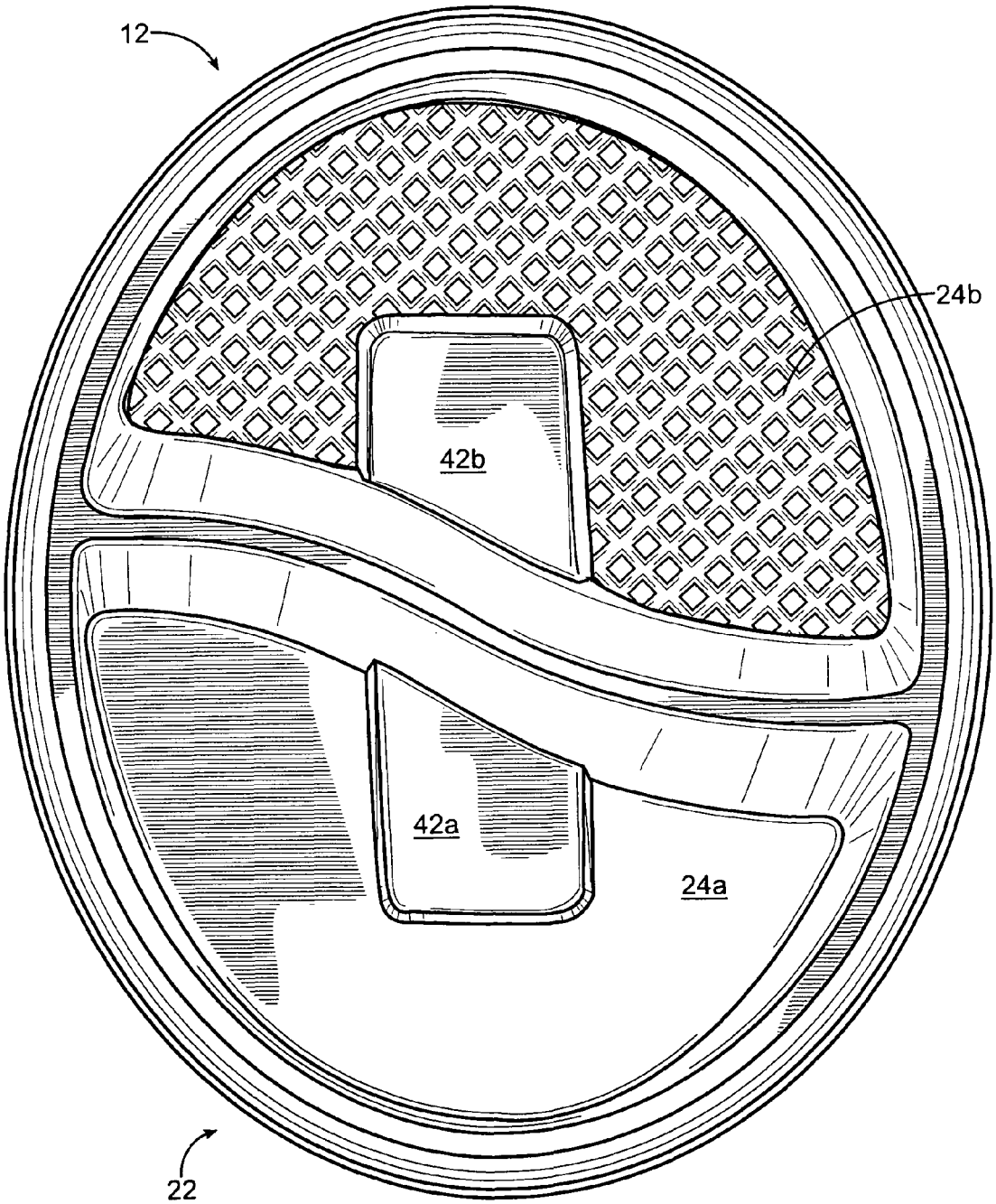
FIG. 1*c* is a bottom view of the base of FIG. 1*a*.

Referring to FIGS. 1*a*-1*c*, the base 12 includes a continuous body portion 20 and a continuous rim 22 encompassing and projecting laterally outwardly from the body portion 20. The body portion 20 includes a bottom 24 and a continuous sidewall 26 encompassing and projecting upwardly and outwardly from the bottom 24. It is contemplated that the sidewall may project only upwardly from the bottom or even project upwardly and inwardly from the bottom. It is also contemplated that the rim may not be continuous, although it is desirably continuous.

The body portion 20 further includes a divider 30 that splits the bottom 24 of the base 12 into a first base section 24*a* and a second base section 24*b*. The divider 30 as shown in FIGS. 1*a*, 1*b* extends generally upwardly from the bottom 24 of the base 12. The divider 30 includes two side walls 30*a*, 30*b* and a generally rounded top surface 30*c*. The side walls 30*a*, 30*b* and the generally rounded top surface 30*c* assist in provided strength to the compartmentalized container. To assist in providing additional structural strength, the divider 30 may be of a general "S" configuration as best depicted in FIG. 1*b*. More specifically, the general "S" configuration of the divider 30 assists in providing flexural strength that assists in minimizing the twisting or bending of the compartmentalized container. It is contemplated that the divider may be of other configurations such as a zig-zag, straight, arched or a generally curvilinear shape. It is also contemplated that the divider may split the bottom of the base into more than two sections.

The divider 30 may be formed by having the bottom 24 thermoformed upwardly such that a gap is formed (see gap 32 of FIG. 1*a*). It is contemplated that the divider may be formed of additional material such that bottom remains generally flat and the divider extends generally across and from the bottom of the base.

The first base section 24*a* and the second base section 24*b* are shown as being generally equal in area in FIGS. 1*a*-1*c*. It is contemplated that the divider may be located in such a manner that the first and second base sections are not equal in size.

By having separate compartments, items (e.g., food items) may be placed in different compartments to prevent or inhibit commingling of items. For example, undesirable mixing of food items can corrupt the flavor and the consistency of the food items.

Referring still to FIGS. 1*a*-1*c*, the first base section 24*a* and the second base section 24*b* may have surfaces configured to hold or contain, for example, certain food items. For example, the first base section 24*a* has a generally smooth surface, while the second base section 24*b* has a patterned surface to assist in trapping liquids therein.

One non-limiting example of a patterned surface is a "waffle" pattern that is depicted in conjunction with the second base section 24*b* in FIGS. 1*a*-1*c*. The waffle pattern 36 includes a plurality of wells 40 that are formed in a grid configuration. It is contemplated that the plurality of wells may be formed in other shapes and sizes. The wells 40 assist in trapping or containing liquids (e.g., juices or grease) that have run off of the food product. More specifically, the liquids will desirably drain into and be contained within the wells in such a manner that food product will have minimized or no contact with the liquids. It is contemplated that other patterns or non-patterns may be formed in the base section to accomplish the same function of trapping or containing liquids.

Figure 8:
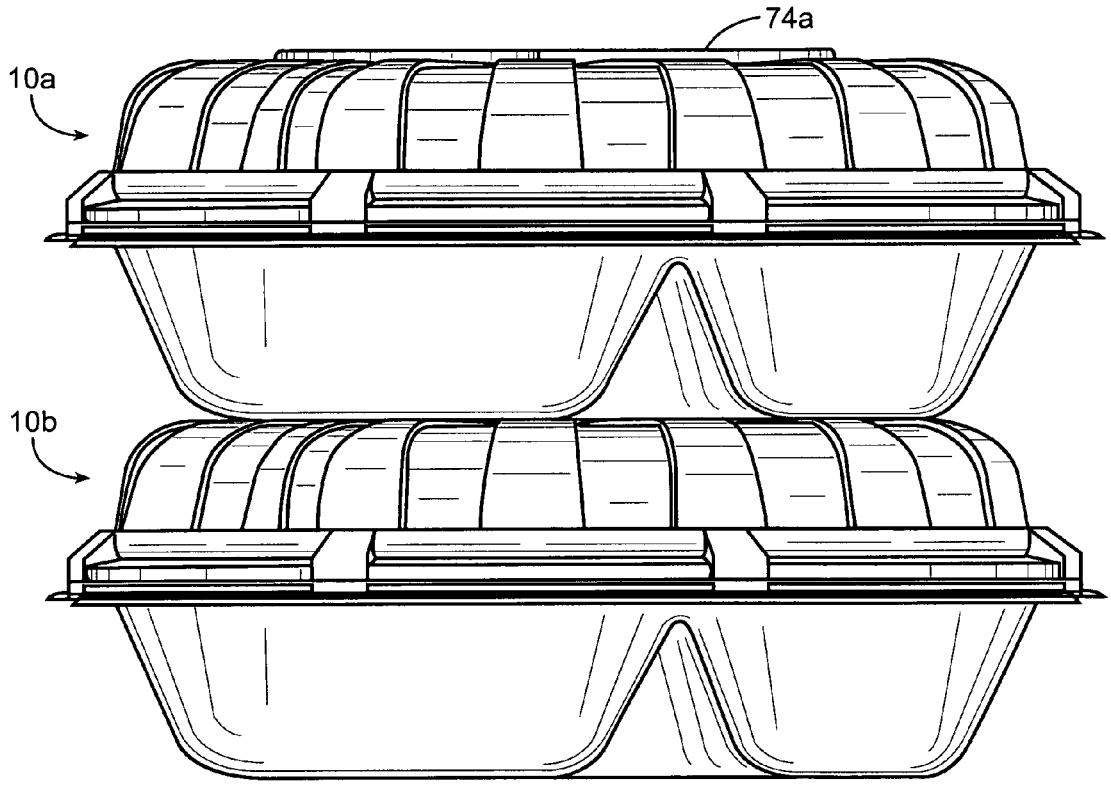
FIG. 8 is a stacked view of two identical compartmentalized containers.

To assist in stacking a plurality of compartmentalized containers, at least one of the first base section and the second base section may have a recessed surface. For example, referring to FIG. 1*c*, the first base section 24*a* and the second base section 24*b* form respective recessed surfaces 42*a*, 42*b*. The recessed surfaces 42*a*, 42*b* corresponds with a stacking projection 74*a* of the lid 16 (see FIGS. 4*b*, 8) to assist in stacking a plurality of compartmentalized containers. The plurality of containers is shown stacked in FIG. 8 with compartmentalized containers 10*a*, 10*b*. The compartmentalized containers 10*a*, 10*b* are identical to the compartmentalized containers 10 described herein. By having a stacking projection and a corresponding recessed portion, multiple compartmentalized containers may be stacked securely with each other.

Referring back to FIGS. 1*a*, 1*b*, the continuous sidewall 26 before transiting to the continuous rim 22 forms a ledge or step 46 at a top edge thereof. The ledge 46, which will be discussed in more detail below, includes a generally flat top surface and assists in receiving and coupling with the insert 14.

Figure 2A:
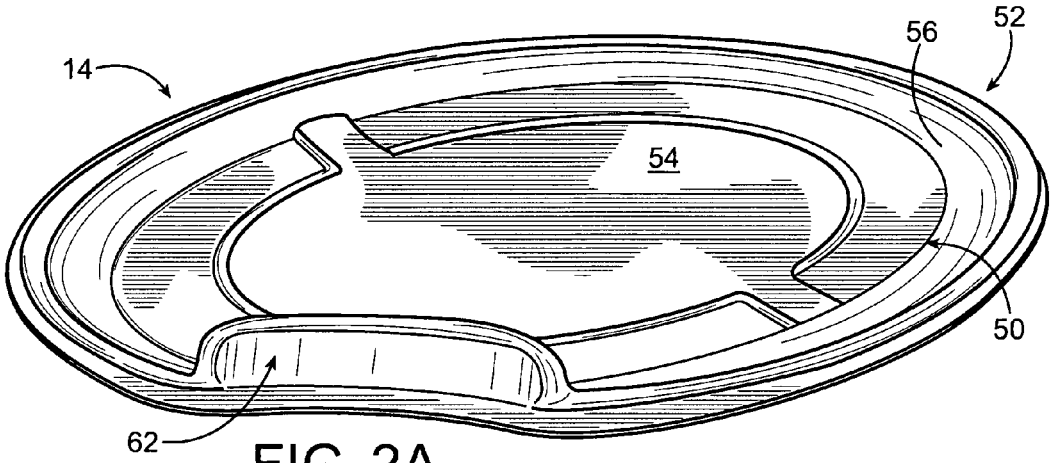
FIG. 2*a* is a perspective view of an insert according to one embodiment to be used in forming a compartmentalized container.
Figure 2B:
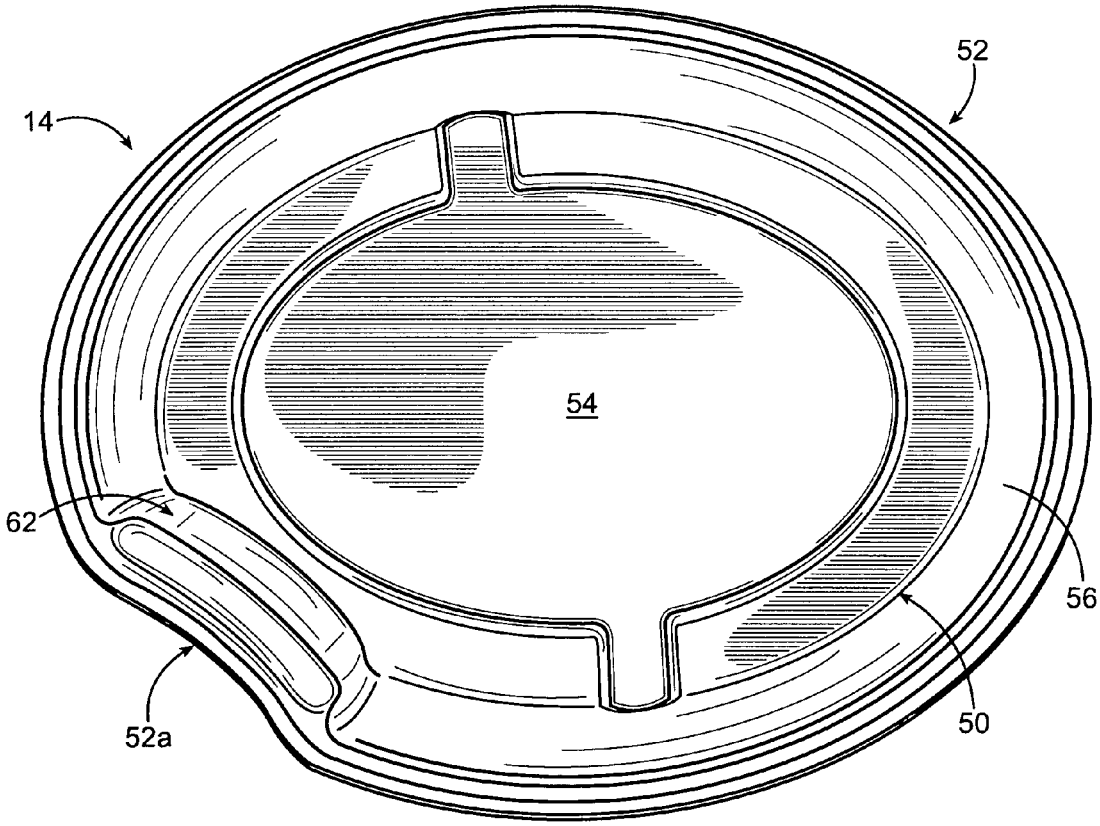
FIG. 2*b* is a top view of the insert of FIG. 2*a*.
Figure 2C:
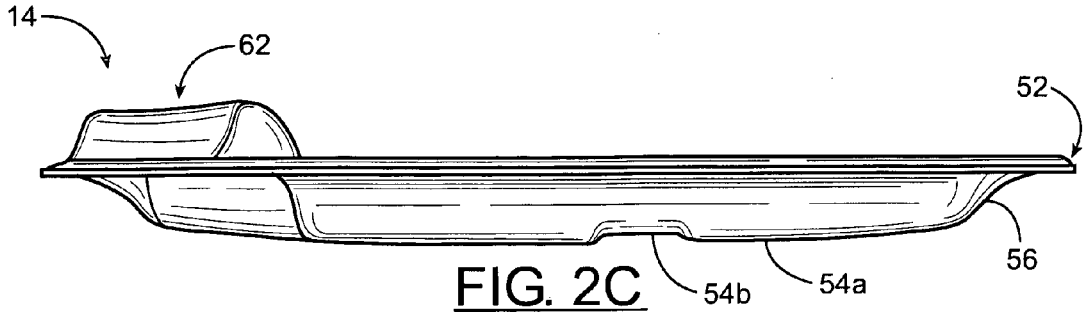
FIG. 2*c* is a side view of the insert of FIG. 2*a*.

Referring to FIGS. 2*a*-2*c*, views of an insert (the insert 14) according to one embodiment to be used in forming a compartmentalized container (compartmentalized container 10) are shown. The insert 14 includes a continuous body portion 50 and a continuous rim 52 encompassing and projecting laterally outwardly from the body portion 50. The body portion 50 includes a bottom 54 and a continuous sidewall 56 encompassing and projecting upwardly and outwardly from the bottom 54.

Figure 3A:
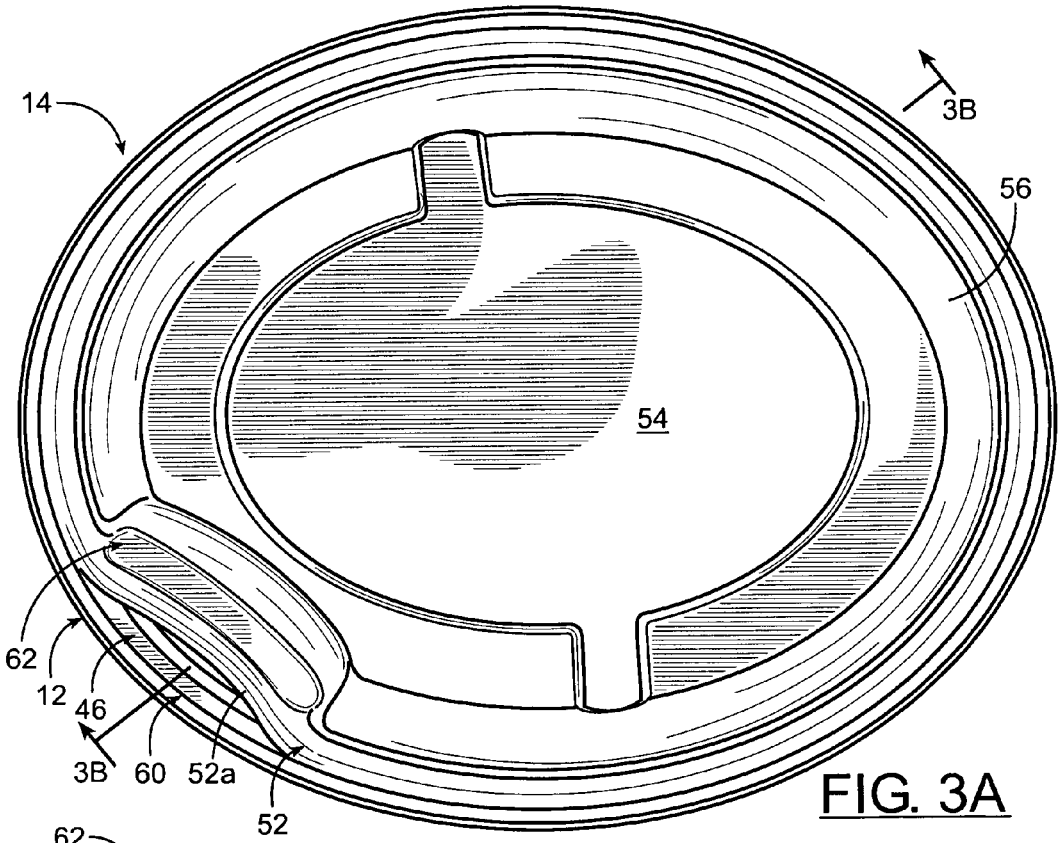
FIG. 3*a* is a top view of the base of FIGS. 1*a*, 1*b* and the insert of FIGS. 2*a*-2*c* in an assembled position.
Figure 3B:
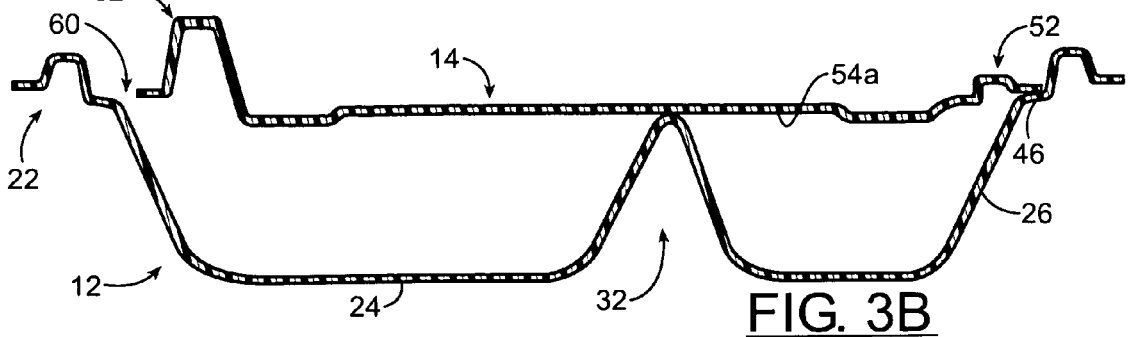
FIG. 3*b* is an enlarged cross-sectional view taken generally along line 3*b*-3*b* of FIG. 3*a*.

The insert 14 is adapted to be assembled into or onto the base 12. Specifically, as shown in FIGS. 3*a*, 3*b*, the continuous rim 52 is adapted to abut or rest on the ledge 46 of the base 12. When the continuous rim 52 of the insert 14 abuts on the ledge 46, a venting area 60 is formed between the insert 14 and the base 12. The venting area 60 is formed when a portion 52*a* of the continuous rim 52 is cut back slightly. The portion 52*a* of the continuous rim 52 does not abut or rest on the ledge 46. As shown in FIG. 3*a*, the venting area 60 is of a general shape of a finger. It is contemplated that the venting area may be of different sizes and shapes to achieve proper venting of the products to be placed in the container.

Referring back to FIGS. 2*a*-2*c*, the insert 14 also includes a protrusion 62 extending upwardly therefrom. As will be discussed in more detail below in conjunction with FIGS. 5*b*, 6*b*, the protrusion 62 assists in preventing or inhibiting the vented air flow from the area between the base 12 and the insert 14 from mixing with the area between the insert 14 and the lid 16.

To assist in further separating or defining the compartments formed by the first base section 24*a* and the second base section 24*b*, the insert 14 (and more specifically the bottom 54) also rests on the top surface 30*c* of the divider 30 in one embodiment. To assist in forming an improved seal therebetween, the top surface 30*c* of the divider 30 and a portion of the bottom surface 54*a* of the insert 14 have a similar contour to assist in forming a seal therebetween. A sufficient seal desirably assists the formed compartments in maintaining separate temperature and humidity conditions over a period of time typically used to store food therein. To assist in properly placing the insert 14 (FIG. 2*c*) with respect to the base 12, the bottom surface 54*a* of the insert 14 forms two slightly recessed portions (one of the recessed portions 54*b* is shown in FIG. 2*c*) that correspond with the top surface 30*c* of the divider 30. A top view of the recessed portions is shown in FIGS. 2*a*, 2*b*.

By forming a seal between the top surface 30*c* of the divider 30 and the bottom surface 54*a* of the insert 14, the first and second base sections 24*a*, 24*b* form generally sealed compartments that assist in inhibiting or preventing air/moisture from moving between the compartments. By having separately sealed compartments, the ability to assist in maintaining different temperatures of food products and humidity levels contained therein is improved. The assembled base 12 and the insert 14 result in a sealed lower compartment with no venting and a vented lower compartment (compartment partially defined by the protrusion 62 and portion 52*a* of the rim 50) are formed. The vented lower compartment vents through the venting area 60. Each of the compartments is designed to have the potential of having different foods at potentially different temperatures stored in a different moisture-content environment. By maintaining food products under different conditions (e.g., temperature and humidity levels), the food products may be optimally stored to obtain freshness. For example, if a product is desired to be hot (e.g., eggs and meat), it may be located in the sealed lower compartment and if a product is desired to be warm and crispy (e.g., hash browns), it may be located in the vented lower compartment.

Figure 4A:
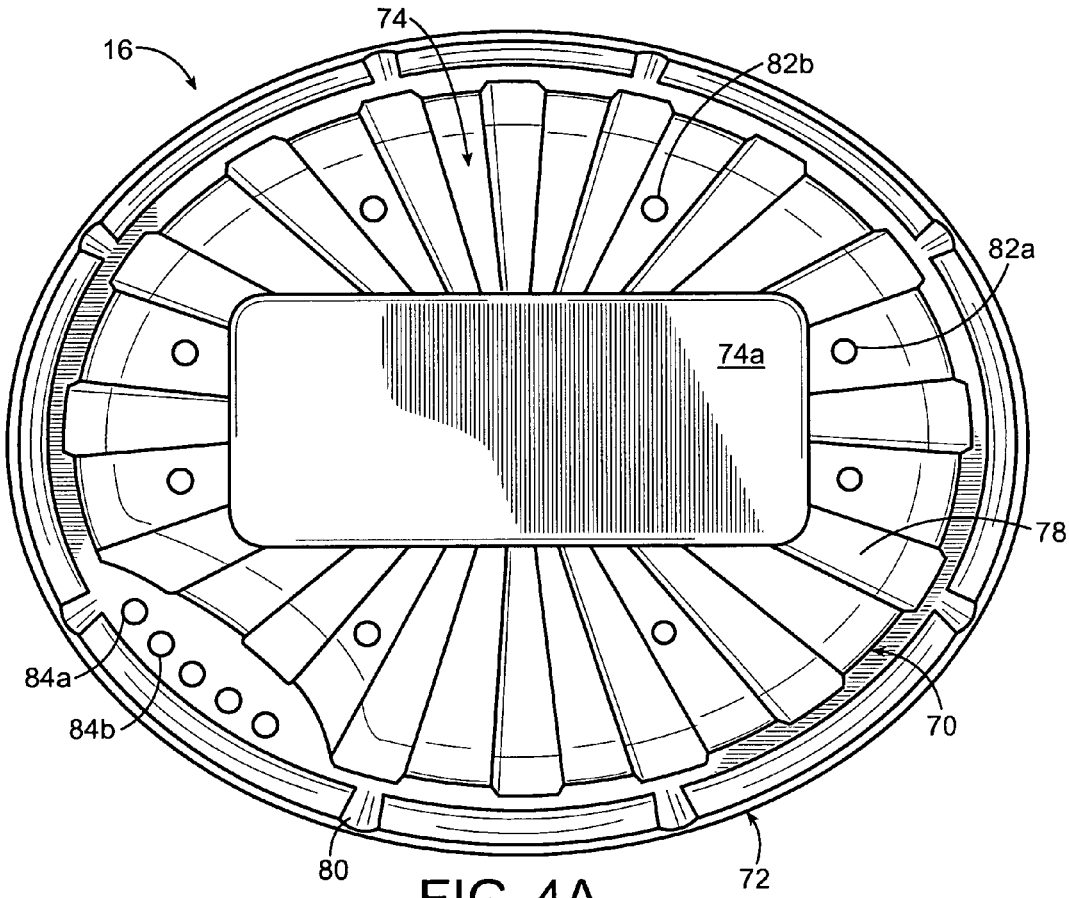
FIG. 4*a* is a top view of a lid according to one embodiment to be used in forming a compartmentalized container.
Figure 4B:
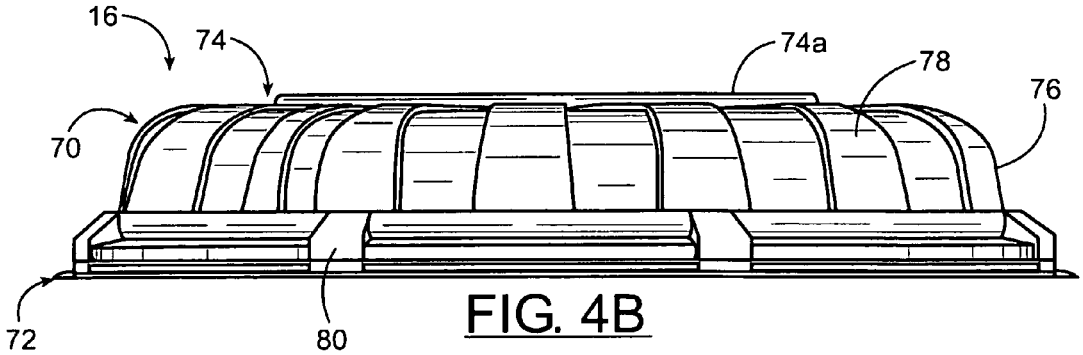
FIG. 4*b* is a side view of the lid of FIG. 4*a*.

Referring to FIGS. 4*a*, 4*b*, views of a lid (the lid 16) according to one embodiment to be used in forming a compartmentalized container (compartmentalized container 10) are shown. The lid 16 includes a continuous body portion 70 and a continuous rim 72 encompassing and projecting laterally outwardly from the body portion 70. The body portion 70 includes a top 74 and a continuous sidewall 76 encompassing and projecting downwardly and outwardly from the top 74. The top 74 includes the stacking projection 74*a* that assists in stacking with the recessed portions 42*a*, 42*b* (FIG. 1*c*) of another compartmentalized container. To provide additional strength to the lid 16, the body portion 70 forms a plurality of spaced ribs 78 therein and the rim 72 also forms a plurality of spaced ribs 80 therein. The plurality of ribs, if used, may be of different shapes and sizes than that depicted in FIGS. 4*a*, 4*b*.

The body portion 70 of the lid 16 also includes multiple areas where venting occurs. Specifically, the top 74 includes a plurality of vents 82 (e.g., vents 82*a*, 82*b*). The plurality of vents 82 is spaced in different locations therearound to assist in venting of food products placed on the insert 14. The vents 82 are generally circular shaped in FIG. 4*a*, but it is contemplated that other numbers, shapes and sizes may be used including polygonal and non-polygonal shapes. The lid 16 also forms a plurality of vents 84 (e.g., vents 84*a*, 84*b*) therein to assist in venting of the food products from the vented lower compartment and through the vented area 60. The vents 84 are generally circular shaped in FIG. 4*a*, but it is contemplated that other numbers, shapes and sizes may be used including polygonal and non-polygonal shapes. For example, the lid may form exactly one vent to assist in venting of the food products from the vented lower compartment.

Figure 9:
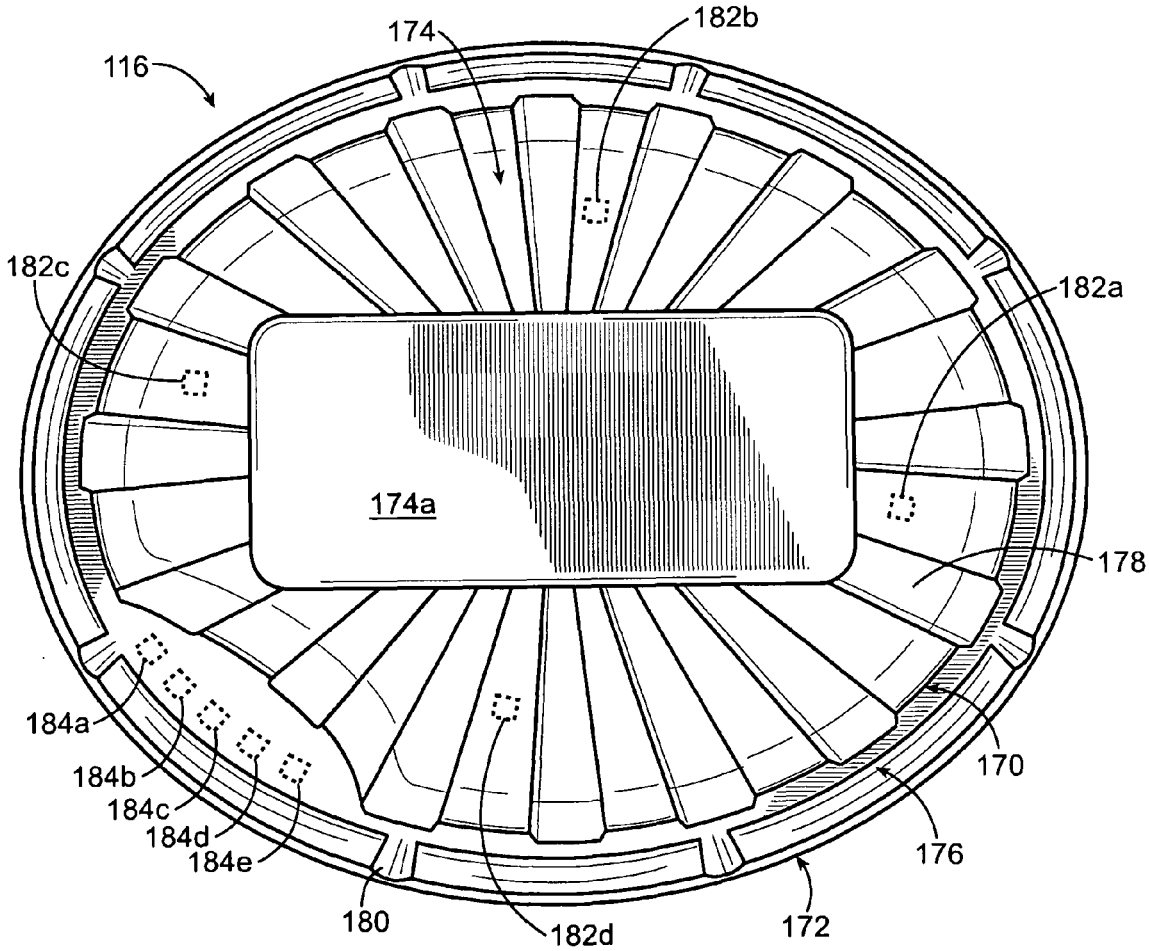
FIG. 9 depicts a top view of a lid with perforated areas adapted to form vents according to one embodiment.

In addition to the venting shown in, for example, FIGS. 4*a*, 5*b*, the venting may be accomplished by other methods. Referring to FIG. 9, a lid 116 includes a continuous body portion 170 and a continuous rim 172 encompassing and projecting laterally outwardly from the body portion 170. The body portion 170 includes a top 174 and a continuous sidewall 176 encompassing and projecting downwardly and outwardly from the top 174. The top 174 includes a stacking projection 174*a* that assists in stacking with the recessed portions 42*a*, 42*b* (FIG. 1*c*) of another compartmentalized container. To provide additional strength to the lid 116, the body portion 170 forms a plurality of spaced ribs 178 therein and the rim 172 also forms a plurality of spaced ribs 180 therein.

The lid 116 of FIG. 9 further includes a plurality of vents 182*a-d* and 184*a-e* that may be formed by perforating or otherwise creating an area of weakness therein. In such an embodiment, a user may "punch out" or otherwise remove the material in the lid 116 to form the vents 182*a-d* and/or 184*a-e*. This may be especially desirable for vents 182*a-d* in which the user may not desire to vent selected items (e.g., food items) in the upper compartment, while desiring venting on other items.

The lid 16 or the lid 116 may be adapted to be assembled with at least one of the insert 14 and the base 12. Referring to FIGS. 5*b*, 5*c*, the lid 16 is assembled with the insert 14 and the base 12. An exploded view of the base 12, insert 14 and the lid 16 is shown in FIG. 5*a*. In this embodiment, as shown best in FIGS. 6*a*, 6*b*, the continuous rim 72 of the lid 16 is adapted to mate with the continuous rim 22 of the base 12. The continuous rim 72 of the lid 16 is mated or interlocked with the continuous rim 22 of the base 12 using a snap fit. The continuous rim 72 may include at least one undercut 72*a* to assist in interlocking the lid and the base. It is contemplated that many other attachment methods may be used such as a rib and groove configuration, a matching dovetail closure system, matching internal undercut closure configuration, a slot- and tab-closure system or a folding snap over closure system. The interlocking features are typically formed only on the rims of the containers, but the interlocking features may extend into or through other portions of the containers. For example, the lid and the base may be hingedly connected.

Figure 6A:
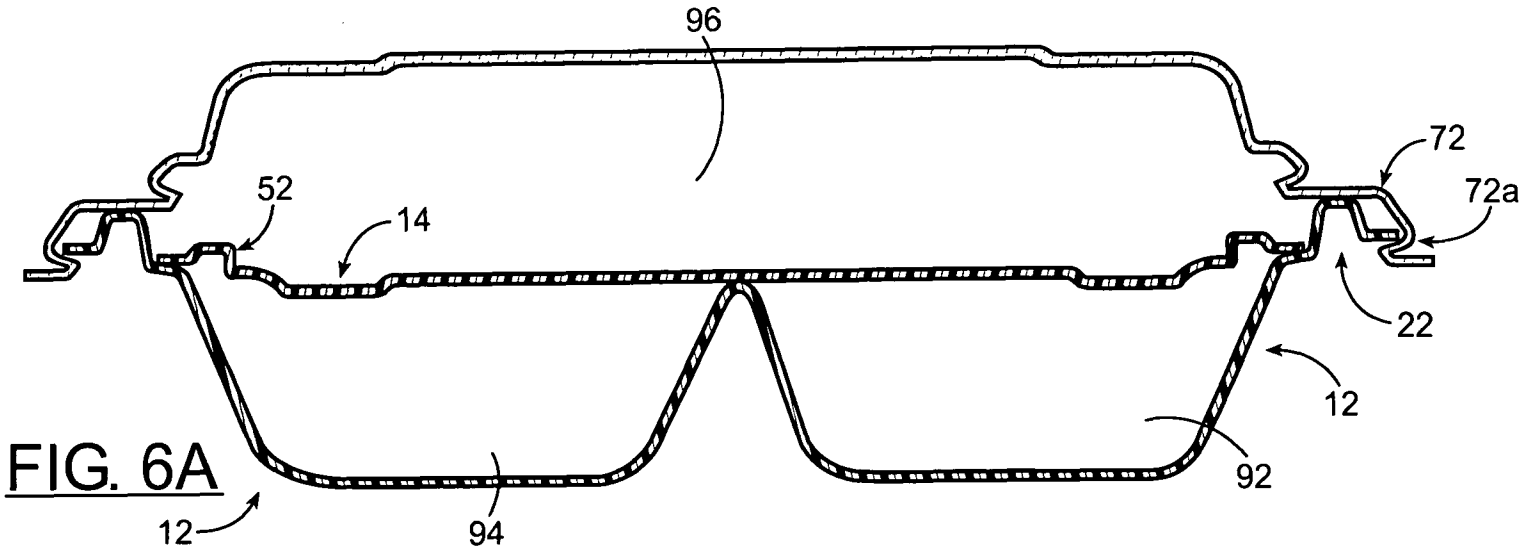
FIG. 6*a* is an enlarged cross-sectional view taken generally along line 6*a*-6*a* of FIG. 5*c*.
Figure 6B:
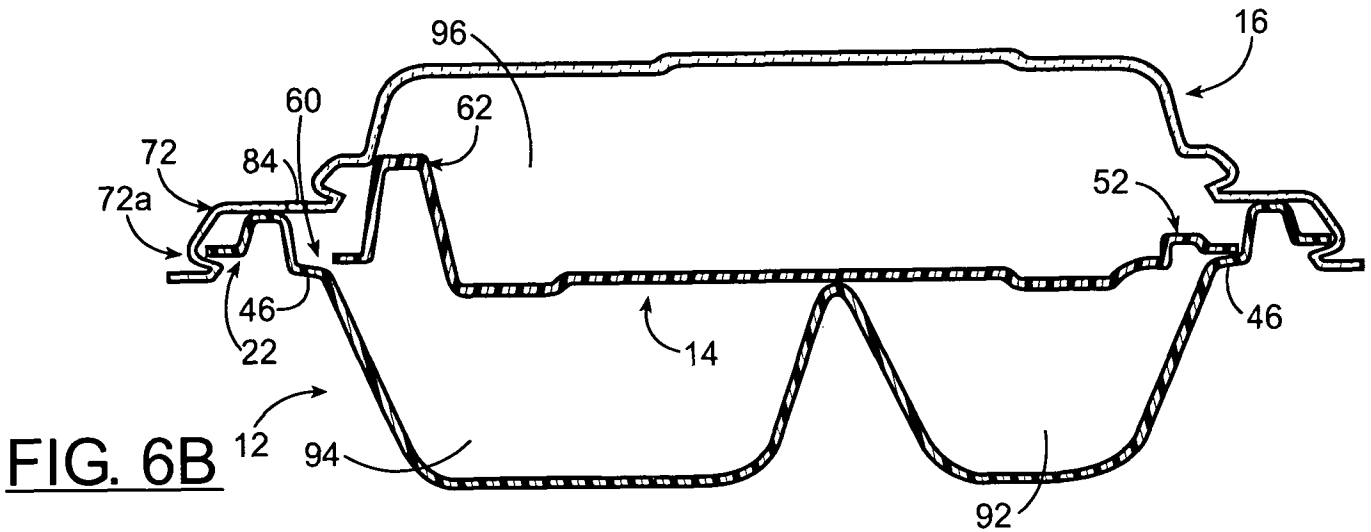
FIG. 6*b* is an enlarged cross-sectional view taken generally along line 6*b*-6*b* of FIG. 5*c*.

In this embodiment, the continuous rim 72 of the lid 16 is not mated or interlocked with the continuous rim 52 of the insert 14 as shown in FIGS. 6*a*, 6*b*. The continuous rim 52 of the insert 14 abuts the ledge 46 of the base 12 and remains in place due to the interference between the protrusion 62 of the insert 14 and the lid 16.

When the base 12, inert 14 and the lid 16 are assembled, the plurality of vents 84 is desirably aligned with the venting area 60, which is formed between the assembled insert 14 and the base 12. It is desirable for the plurality of vents 84 and the venting area 60 to be generally aligned with each other such that any venting from a vented lower compartment 94 is directly vented to the atmosphere when the lid is assembled with the base and the insert. This "chimney" vent allows for direct venting to the atmosphere of the vented lower compartment 94 without venting to an upper compartment 96 formed between the insert 14 and the lid 12. As shown in FIG. 6*b*, the protrusion 62 of the insert 14 assists in directing the gases from the venting area 60 directly through the plurality of vents 84. Thus, by having the protrusion 62, the likelihood of the gases from the lower vented compartment entering the upper vented compartment formed between the insert 14 and the lid 16 is significantly reduced. The upper vented compartment may include food items different from or the same as the lower compartments. One example of a food item that may be included in the upper compartment would be pancakes or other side items.

Thus, the compartmentalized container of FIGS. 5*b*, 5*c* provides a first lower compartment 92 to be sealed with no venting, the second lower compartment 94 with dedicated venting, and the upper vented compartment 96 with separate dedicated venting. As discussed above, the upper compartment may not be vented if, for example, the vents 182*a-d* of lid 116 of FIG. 9 are not removed. Each of the compartments is designed to have different specific foods therein and also to assist in maintaining the freshness of each of the foods. In this embodiment, each of the compartments 92, 94, 96 is sealed from each of the other compartments.

Figure 7A:
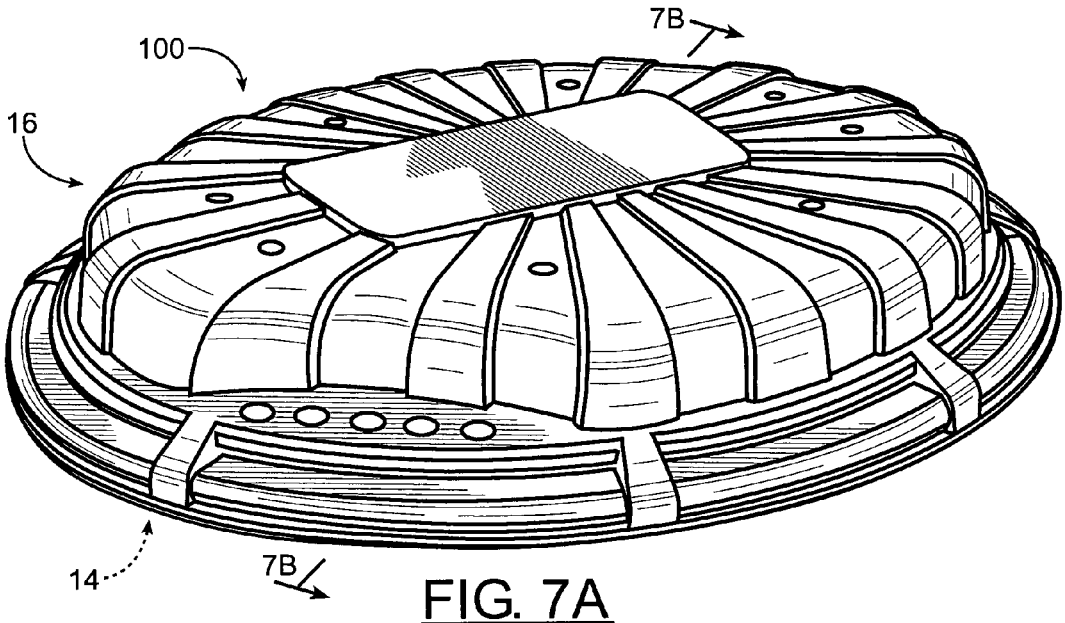
FIG. 7*a* is a side view of the insert of FIGS. 2*a*-2*c* and the lid of FIGS. 4*a*, 4*b* in an assembled position.
Figure 7B:
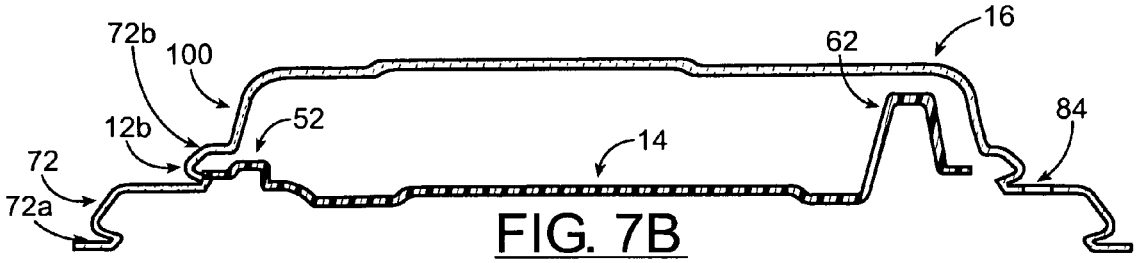
FIG. 7*b* is an enlarged cross-sectional view taken generally along line 7*b*-7*b* of FIG. 7*a*.

The continuous rim 72 of the lid 16 has a two level-closure design that is adapted to be individually interlocked with the base 12 in one embodiment (FIGS. 5*b*, 5*c*, 6*a*, 6*b*) or with the insert 14 in another embodiment (FIGS. 7*a*, 7*b*). By having a two level-closure design, this allows flexibility in forming the compartmented container. For example, the lid, base and insert may be assembled to form a three-piece compartmented container. In another method, the lid and insert may be assembled to form a two-piece container 100. This is shown in FIGS. 7*a*, 7*b* with the lid 16 and the insert 14 being interlocked with each other. The lid 16 and the insert 14 are interlocked using a second undercut 72*b*. The two-piece container may be used for packaging of other food products. Thus, by having a two level-closure system, this eliminates the need for another specialty package for use.

As discussed above in conjunction with FIGS. 3*a*, 3*b*, it is contemplated that other closure designs may be used in which the lid may individually attach to both the insert and base. It is also contemplated that a system may be designed in which the lid is attached to the insert and base at the same time.

Figure 10:
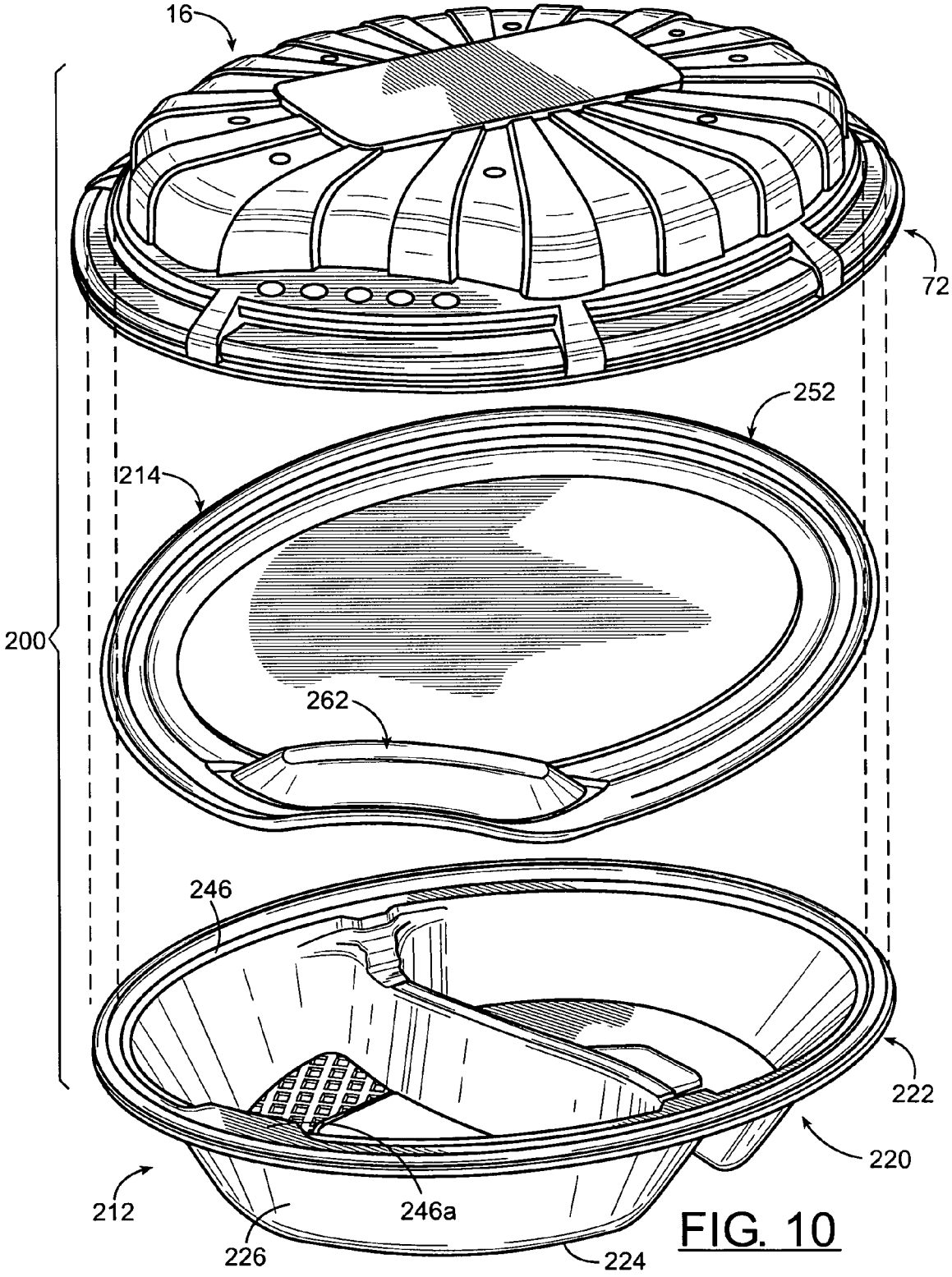
FIG. 10 is an exploded view of a base, an insert and the lid of FIGS. 4*a*, 4*b* according to one embodiment.

It is contemplated that other configurations of a compartmentalized container may be formed. For example, referring to FIG. 10, a compartmentalized container 200 includes the lid 16, an insert 214 and a base 212. The insert 214 includes a continuous rim 252 and a protrusion 262. The protrusion 262 is used in a similar manner as described above with the protrusion 62. The base 212 includes a continuous body portion 220 and a continuous rim 222. The continuous body portion 220 includes a sidewall 226 and a bottom 224. The continuous sidewall 226 before transiting to the continuous rim 222 forms a ledge or step 246. The ledge 246 has an enlarged area 246*a* that assists the user in locating the insert 214 with the protrusion 262 in a desirable location.

Figure 11:
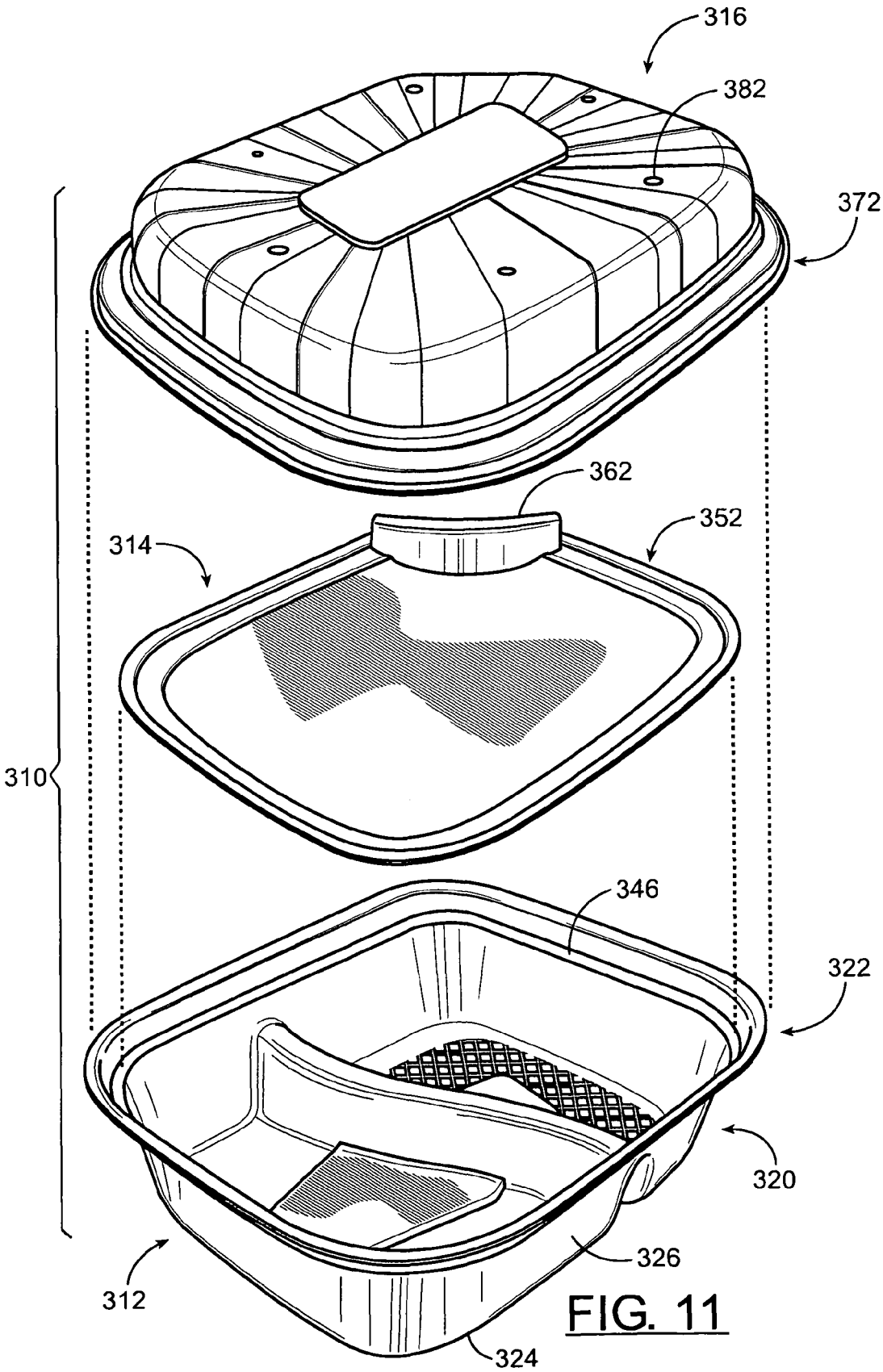
FIG. 11 is an exploded view of a base, an insert and a lid having a generally rectangular configuration according to one embodiment.

As discussed above, the compartmentalized container may be other shapes such as rectangular, square, hexagonal, octagonal or other polygonal and non-polygonal shapes. A non-limiting example of a compartmentalized container is shown in FIG. 11. FIG. 11 is an exploded view of a compartmentalized container 310 that includes a base 312, an insert 314 and a lid 316. The base 312 includes a continuous body portion 320 and a continuous rim 322. The continuous body portion 320 includes a sidewall 326 and a bottom 324. The continuous sidewall 326 before transiting to the continuous rim 322 forms a ledge or step 346. The insert 314 includes a continuous rim 352 and a protrusion 362. The lid 316 includes a continuous rim 372. The lid 316 forms a plurality of vents 382 and also forms a plurality of vents similar to vents 84*a, b* of FIG. 4*a*.

Figure 12:
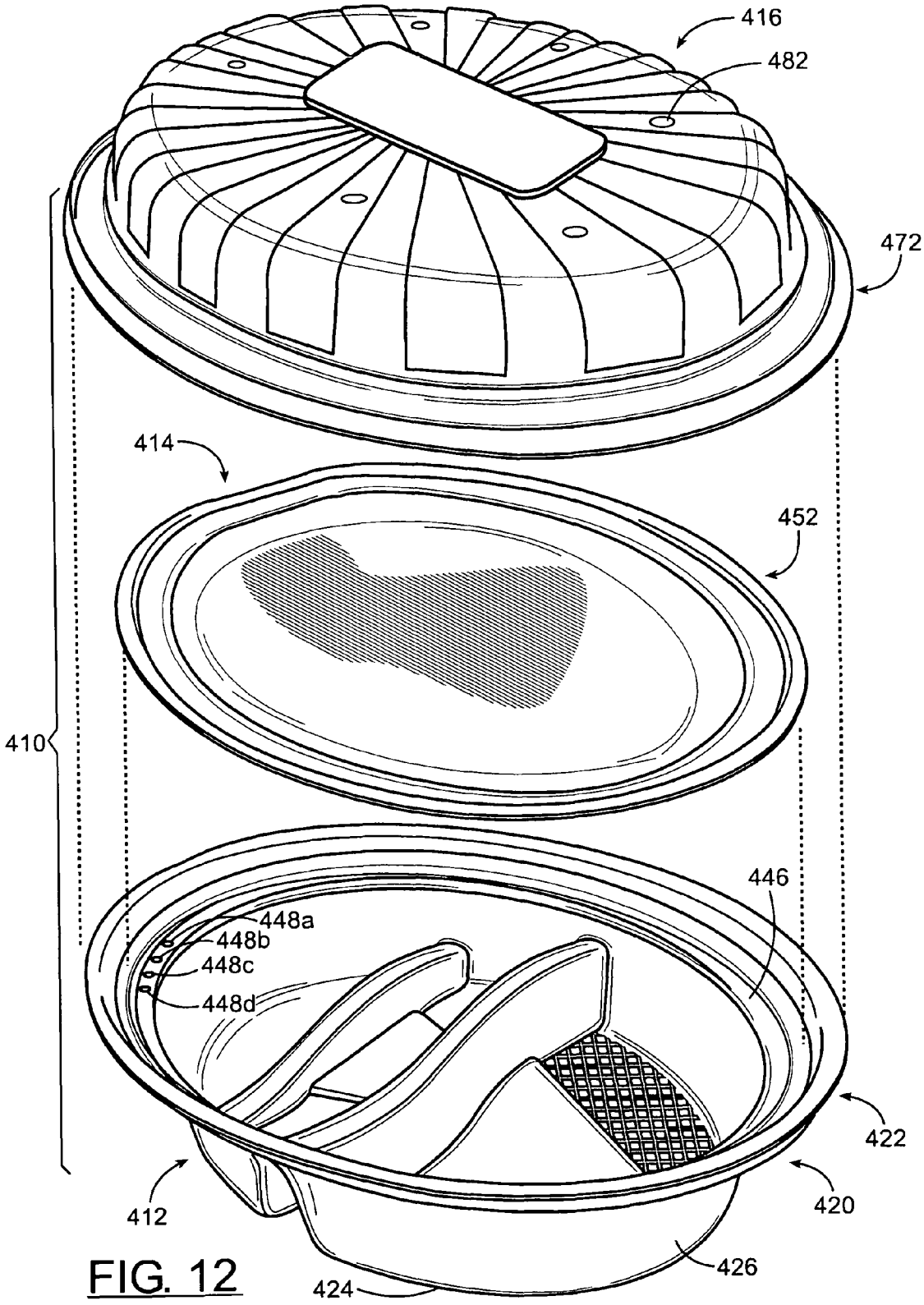
FIG. 12 is an exploded view of a base, an insert and a lid according to another embodiment.
Figure 13:
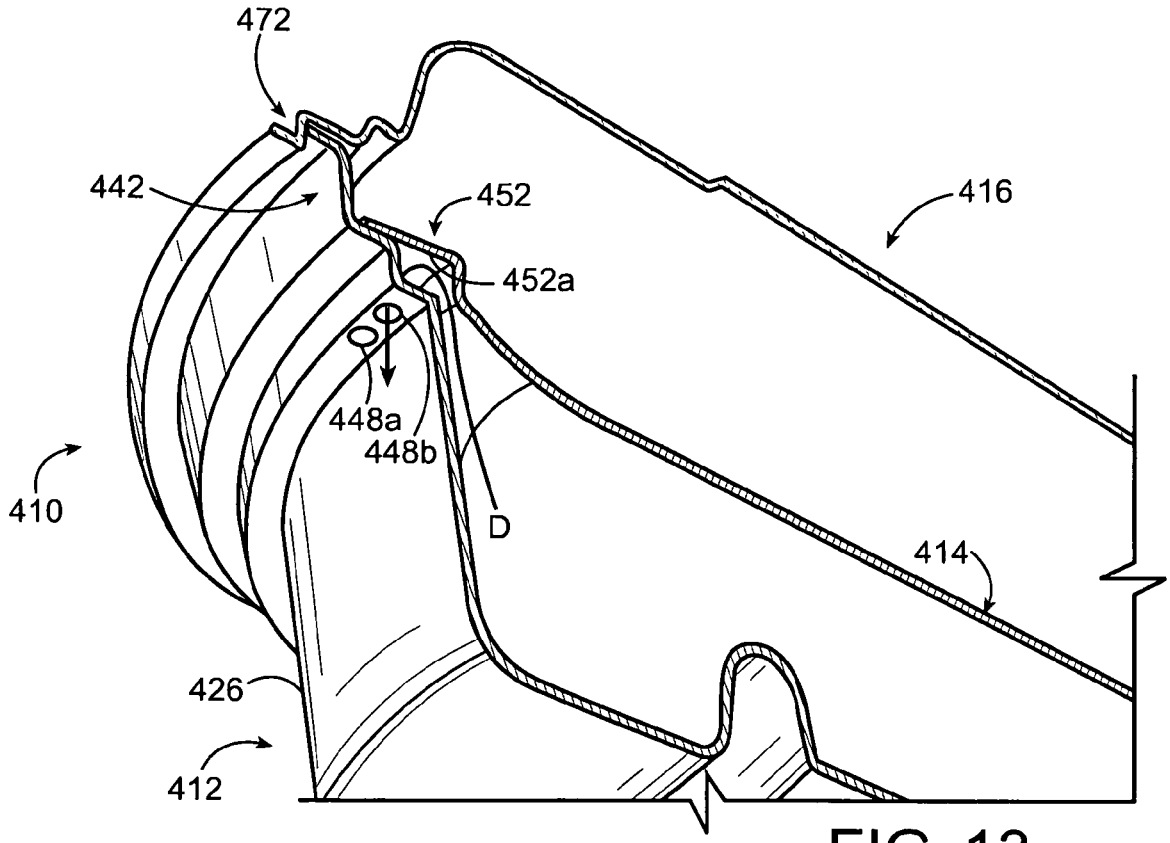
FIG. 13 is an enlarged cross-sectional view of the assembled container of FIG. 12 taken generally across the area where the venting occurs.

It is contemplated that other locations for the venting of a lower compartment may be used. For example, the venting may occur through the sidewall of the base, in which the venting would typically be located at or near the continuous rim. A non-limiting example of such venting container is shown in FIGS. 12 and 13. FIG. 12 is an exploded view of a compartmentalized container 410 that includes a base 412, an insert 414 and a lid 416. The base 412 includes a continuous body portion 420 and a continuous rim 422. The continuous body portion 420 includes a sidewall 426 and a bottom 424. The continuous sidewall 426 before transiting to the continuous rim 422 forms a ledge or step 446. The ledge 446 forms a plurality of vents 448*a-d*. The insert 414 includes a continuous rim 452. The lid 416 includes a continuous rim 472 and forms a plurality of vents 482. As best shown in FIG. 13, venting from the contents of the base 412 travels along a path of arrow D into a space beneath a bottom surface 452*a* of the continuous rim 452 and through the plurality of vents 448 of which vents 448*a*, 448*b* are depicted in FIG. 13. The continuous rim 452 is designed to provide adequate space for the venting to escape through the plurality of vents 448.

It is also contemplated that the venting may also occur over the edge of the insert. In such an embodiment, the base and the lid would not be typically interlocked at such a location so as to provide an area for the moisture to escape the sealed lower vented compartment. More specifically, the moisture escapes over the continuous rim of the base and along a lower side of the insert. A non-limiting example of such venting is shown in FIGS. 14 and 15.

Figure 14:
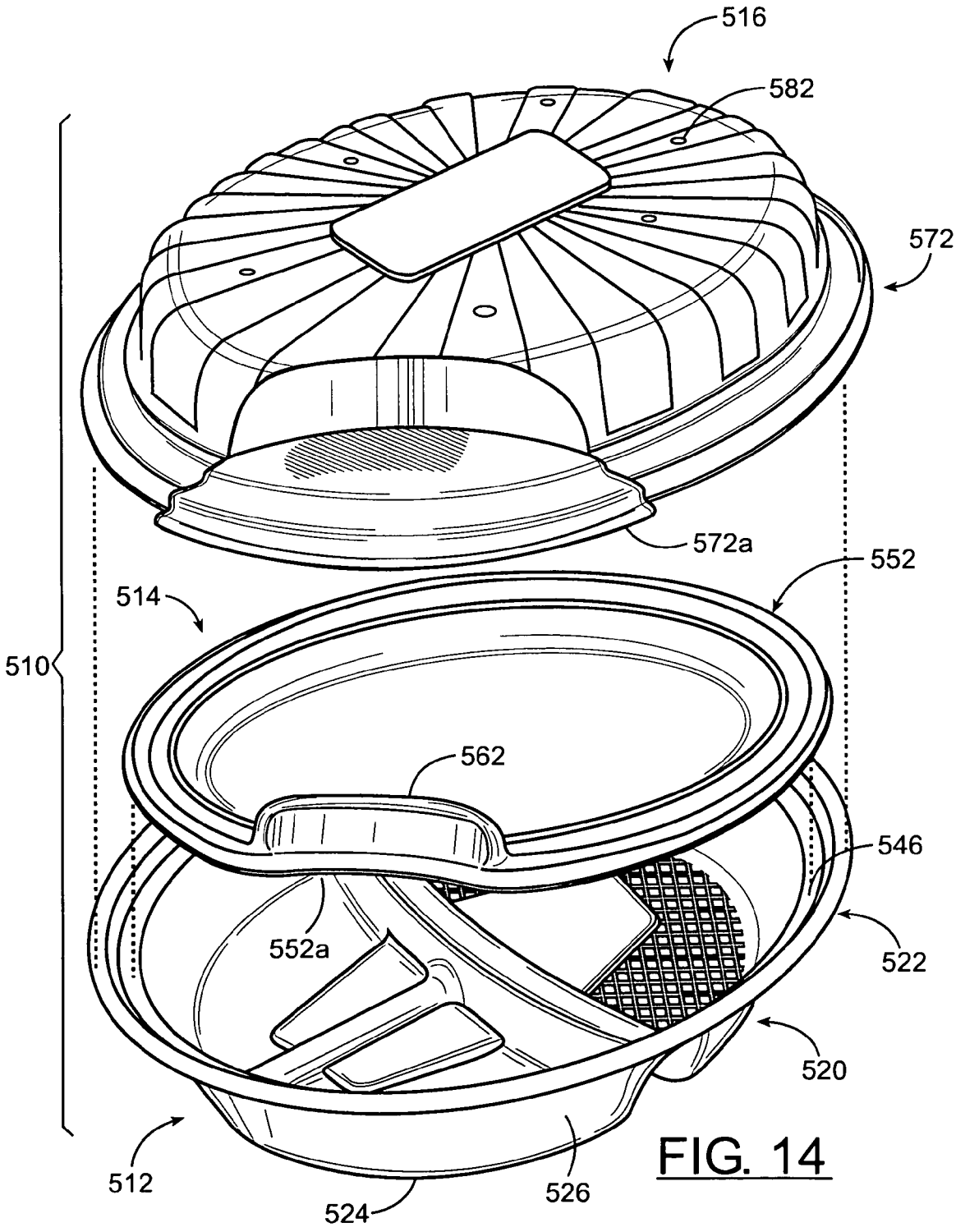
FIG. 14 is an exploded view of a base, an insert and a lid-according to a further embodiment.
Figure 15:
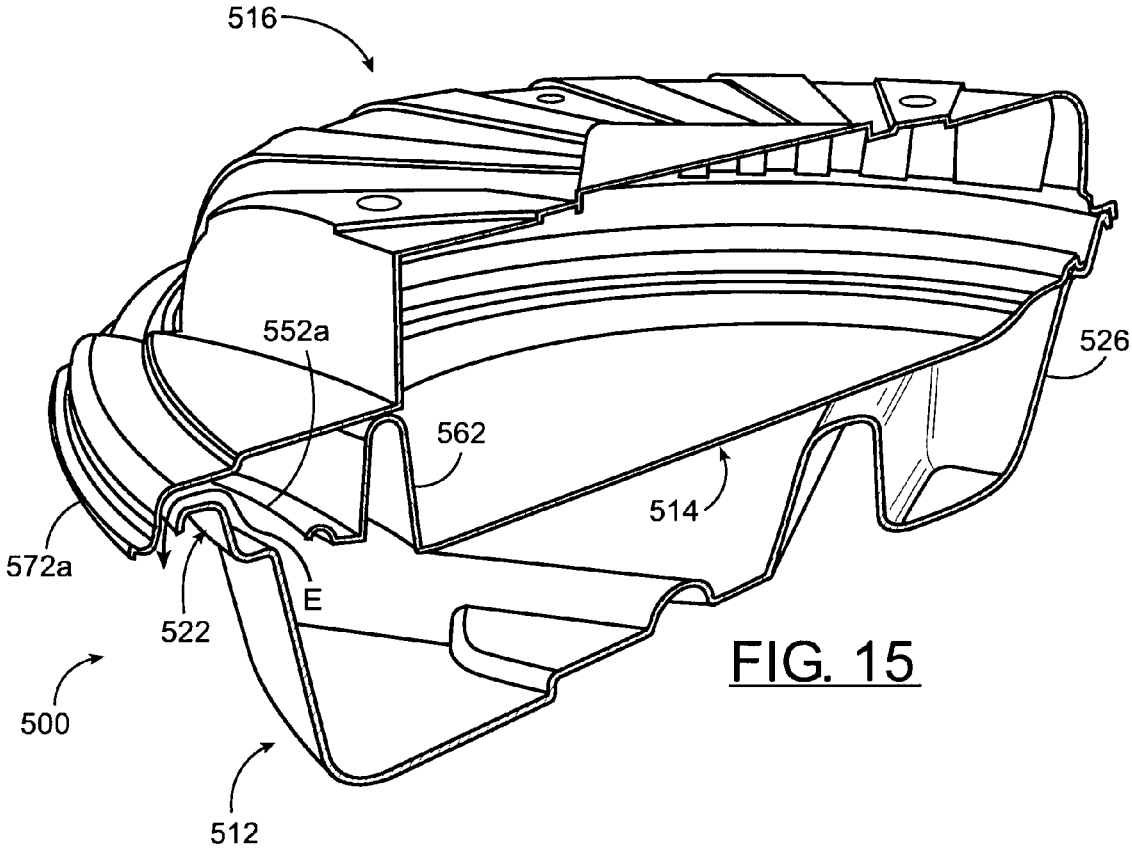
FIG. 15 is an enlarged cross-sectional view of the assembled container of FIG. 14 taken generally across the area where the venting occurs.

FIG. 14 is an exploded view of a compartmentalized container 510 that includes a base 512, an insert 514 and a lid 516. The base 512 includes a continuous body portion 520 and a continuous rim 522. The continuous body portion 520 includes a sidewall 526 and a bottom 524. The continuous sidewall 526 before transiting to the continuous rim 522 forms a ledge or step 546. The insert 514 includes a continuous rim 552 and a protrusion 562. The continuous rim 552 rests or abuts on the ledge 546. The lid 516 includes a continuous rim 572 and forms a plurality of vents 582. The continuous rim 572 forms an overhanging area 572*a* that assists in venting from the base by forming a venting space. As shown best in FIG. 15, venting from the contents of the base 512 travels along a path of arrow E into a space formed between the continuous rim 522 and the overhanging area 572*a* of the continuous rim 572. The continuous rim 552 of the insert 514 is cutaway at portion 552*a*, which allows a space to be formed between portion 552*a* and the continuous rim 522.

The compartmentalized containers are typically formed from polymeric materials, but may be formed from other materials such as paper or metal. The polymeric compartmentalized containers may be formed from polyolefins. The polymeric food containers are typically formed from polystyrene (e.g., orientated polystyrene (OPS)), polyethylene terephthalate (PET) (e.g., APET), polyvinyl chloride (PVC), polypropylene, and combinations thereof. It is contemplated that one of ordinary skill in the art will recognize that other polymers or combination of polymers may be used to form the containers.

The compartmentalized containers may be made from a mineral-filled polymeric material such as, for example, talc or calcium carbonate-filled polyolefin. One specific non-limiting example is a talc-filled polypropylene.

The compartmentalized containers may be formed from polymeric materials that are foamable. For example, the base and the insert may include a polystyrene foam, while the lid is formed from OPS. To assist the consumer in viewing the products (e.g., food products) within the container, the lid is typically formed from a material that is translucent or transparent. To assist in providing improved temperature retention, the base and/or insert may include an insulating material such as a foamable material (e.g., polystyrene foam).

An example of paper that may be used in forming the compartmentalized containers is paperboard or molded fiber. Paperboard and molded fiber typically have a sufficient coefficient of friction to maintain the compartmentalized container in a lockable position.

The compartmentalized containers of the present invention are typically disposable, but it is contemplated that they may be reused at a future time.

The containers may be formed using conventional thermoforming (e.g., by pressure, vacuum or the combination thereof), injection-molding processes, or rotational molding. According to one method of thermoforming, pellets of a polymeric resin and additives, if any, are added into an extruder. The pellets of the polymeric resin and additives, if any, are melted to form a blend. The blend is extruded through a die to form an extruded sheet. The extruded sheet is thermoformed to a desired shape of a container.

The thickness of the compartmentalized containers generally ranges from about 0.002 to about 0.15 inch, but is typically from about 0.005 to about 0.04 inch. The compartmentalized containers may be opaque or a variety of colors or color combinations.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A compartmentalized container comprising:

a base including a bottom and a sidewall, the sidewall encompassing and extending generally upwardly from the bottom;

an insert being coupled with the base, the coupled insert and the base forming a first vent, the insert including a first surface and a second surface, the first vent being formed from a space being defined by the first surface of the insert and the base; and a lid being coupled with at least one of the insert and the base, the lid forming at least one lid vent that is in communication with the first vent, wherein the base, the insert and the lid assist in forming separated first and second compartments in the compartmentalized container, the first compartment being adapted to receive at least one item on the bottom of the base, the second compartment being adapted to receive at least one item on the second surface of the insert.

2. The compartmentalized container of claim 1 wherein the base further includes a divider, the divider splitting the bottom of the base into at least a first base section and a second base section.

3. The compartmentalized container of claim 2 wherein the first base section has a generally smooth surface and the second base section has a plurality of wells to assist in trapping liquids therein.

4. The compartmentalized container of claim 1 wherein the sidewall of the base further includes a ledge formed thereon, the insert abutting and resting on the ledge when coupled.

5. The compartmentalized container of claim 1 wherein the lid vent and the first vent are generally aligned with each other.

6. A compartmentalized container comprising:

a base including a bottom and a sidewall, the sidewall encompassing and extending generally upwardly from the bottom;

an insert being coupled with the base, the coupled insert and the base forming a first vent, the insert including a first surface and a second surface, the first vent being formed from a space being defined by the first surface of the insert and the base; and a lid being coupled with at least one of the insert and the base, the lid forming at least one lid vent that is in communication with the first vent, wherein the insert includes a protrusion, the protrusion extending from the second surface of the insert and assisting in preventing or inhibiting vented air flow from the first vent from reaching an area between the second surface of the insert and lid.

7. The compartmentalized container of claim 1 wherein the sidewall of the base extends outwardly from the bottom.

8. A compartmentalized container comprising:

a base including a bottom and a sidewall, the sidewall encompassing and extending generally upwardly from the bottom;

an insert being coupled with the base, the coupled insert and the base forming a first vent, the insert including a first surface and a second surface, the first vent being formed from a space being defined by the first surface of the insert and the base; and a lid being coupled with at least one of the insert and the base, the lid forming at least one lid vent that is in communication with the first vent, wherein the lid is coupled with the base in an interlocking manner.

9. The compartmentalized container of claim 8 wherein the lid interlocks with the base using at least one undercut.

10. The compartmentalized container of claim 1 wherein the lid forms a plurality of lid vents.

11. A compartmentalized container comprising:

a base including a bottom and a sidewall, the sidewall encompassing and extending generally upwardly from the bottom;

an insert being coupled with the base, the coupled insert and the base forming a first vent, the insert including a first surface and a second surface, the first vent being formed from a space being defined by the first surface of the insert and the base; and a lid being coupled with at least one of the insert and the base, the lid forming at least one lid vent that is in communication with the first vent, wherein the lid has a closure system that is adapted to independently interlock with the insert and the base.

12. The compartmentalized container of claim 1 wherein at least one of the base, the insert or the lid includes a polymer.

13. The compartmentalized container of claim 12 wherein the base, the insert and the lid includes a polymer.

14. The compartmentalized container of claim 1 wherein the base is a foamable material.

15. The compartmentalized container of claim 1 wherein the base, lid and the insert form a plurality of compartments, each of the plurality of compartments being sealed from the other remaining compartments.

16. A compartmentalized container comprising:

a base including a bottom, a sidewall and a divider, the sidewall encompassing and extending generally upwardly from the bottom, the divider splitting the bottom of the base into at least a first base section and a second base section, the divider including a top surface;

an insert being coupled with the base, the assembled insert and base forming a first vent, the insert including a first surface and a second surface, the first vent being formed from a space being defined by the first surface of the insert and the base, the insert resting on at least a portion of the top surface of the divider; and a lid being coupled with at least one of the insert and the base, the lid forming at least one lid vent that is in communication with the first vent.

17. The compartmentalized container of claim 16 wherein the insert has a bottom surface, the top surface of the divider and the bottom surface of the insert having a similar contour to assist in forming a seal therebetween.

18. The compartmentalized container of claim 16 wherein the divider splits the bottom into exactly a first base section and a second base section.

19. The compartmentalized container of claim 16 wherein the container has exactly three compartments.

20. The compartmentalized container of claim 16 wherein the base, lid and the insert form a plurality of compartments, each of the plurality of compartments being sealed from the other remaining compartments.

21. The compartmentalized container of claim 16 wherein the divider is of a general "S" configuration.

22. A method of forming a compartmentalized container, the method comprising:

providing a base including a bottom and a sidewall, the sidewall encompassing and extending generally upwardly from the bottom;

providing a lid;

coupling an insert with the base, the assembled insert and the base forming a first vent, the insert including a first surface and a second surface, the first vent being formed from a space being defined by the first surface of the insert and the base; and interlocking the lid with the base to form the compartmentalized container, the lid forming at least one lid vent that is in communication with the first vent.

23. A method of forming a compartmentalized container, the method comprising:

providing a base including a bottom, a sidewall and a divider, the sidewall encompassing and extending generally upwardly from the bottom, the divider splitting the bottom of the base into at least a first base section and a second base section, the divider including a top surface;

coupling an insert with the base, the assembled insert and the base forming a first vent, the insert including a first surface and a second surface, the first vent being formed from a space being defined by the first surface of the insert and the base, the insert resting on at least a portion of the top surface of the divider; and interlocking a lid with at least one of the insert and the base to form the compartmentalized container, the lid forming at least one lid vent that is in communication with the first vent.

24. A compartmentalized container comprising:

a base including a bottom, a sidewall and a divider, the sidewall encompassing and extending generally upwardly from the bottom, the divider splitting the bottom of the base into at least a first base section and a second base section, the divider including a top surface;

an insert being coupled with the base, the assembled insert and the base forming a venting area, the insert resting on at least a portion of the top surface of the divider; and a lid being coupled with at least one of the insert and the base, the lid including a continuous rim, the continuous rim of the lid having an overhanging portion such that a venting space occurs between the lid and the base, the venting space being in communication with the venting area.

25. A compartmentalized container comprising:

a base including a bottom, a sidewall, a continuous rim, and a divider, the sidewall encompassing and extending generally upwardly from the bottom, the continuous rim encompassing and extending generally outwardly from the sidewall, the continuous rim including at least a first ledge and a second ledge, the first ledge of the continuous rim forming at least one ledge vent, the divider splitting the bottom of the base into at least a first base section and a second base section, the divider including a top surface;

an insert being coupled with the second ledge of the continuous rim, the assembled insert and base forming a venting area that is in communication with the at least one ledge vent, the insert resting on at least a portion of the top surface of the divider; and a lid being coupled with at least one of the insert and the base.

* * * * *